US008370138B2

(12) United States Patent
Kawashima et al.

(10) Patent No.: US 8,370,138 B2
(45) Date of Patent: Feb. 5, 2013

(54) SCALABLE ENCODING DEVICE AND SCALABLE ENCODING METHOD INCLUDING QUALITY IMPROVEMENT OF A DECODED SIGNAL

(75) Inventors: Takuya Kawashima, Ishikawa (JP); Hiroyuki Ehara, Kanagawa (JP); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1113 days.

(21) Appl. No.: 12/293,302

(22) PCT Filed: Mar. 15, 2007

(86) PCT No.: PCT/JP2007/055188

§ 371 (c)(1),
(2), (4) Date: Sep. 17, 2008

(87) PCT Pub. No.: WO2007/119368

PCT Pub. Date: Oct. 25, 2007

(65) Prior Publication Data

US 2009/0070107 A1 Mar. 12, 2009

(30) Foreign Application Priority Data

Mar. 17, 2006 (JP) ..... 2006-075535

(51) Int. Cl.
*G10L 19/02* (2006.01)

(52) U.S. Cl. ..... 704/229; 704/208; 704/214

(58) Field of Classification Search ..... 704/229, 704/208, 214
See application file for complete search history.

(56) References Cited

U.S. PATENT DOCUMENTS 6,301,558 B1 10/2001 Isozaki
6,446,037 B1 * 9/2002 Fielder et al. ..... 704/229
7,406,410 B2 * 7/2008 Kikuiri et al. ..... 704/221
7,460,479 B2 * 12/2008 LeBlanc ..... 370/235
7,848,921 B2 12/2010 Ehara
(Continued)

FOREIGN PATENT DOCUMENTS

EP 1673764 A1 4/2005
EP 1699043 A1 9/2006
(Continued)

OTHER PUBLICATIONS

Johansson I et al., "Bandwidth efficient amr operation for voip", Speech Coding, 2002, IEEE Workshop Proceedings, Oct. 6-9, 2002, Piscataway, NJ, USA, IEEE, XP010647243 , Oct. 6, 2002, pp. 150-152.

(Continued)

*Primary Examiner* — Jakieda Jackson
(74) *Attorney, Agent, or Firm* — Greenblum & Bernstein, P.L.C.

(57) ABSTRACT

A scalable encoding device is capable of improving quality of a decoded signal without increasing an encoding amount and compensating data with a sufficient quality upon data loss. An extension layer bit distribution calculator calculates a bit distribution of a quality improving encoding data and compensation encoding data in the extension layer according to an audio mode of the input signal. An extension layer encoder generates quality improving encoding data according to the specified number of bits. A compensation information encoder extracts a part of core layer encoding data and makes it as compensation encoding data for the core layer. An extension layer encoded data generator multiplexes the extension layer bit distribution information, the compensation encoding data, and the quality improving encoding data so as to obtain extension layer encoding data.

18 Claims, 6 Drawing Sheets

U.S. PATENT DOCUMENTS

| | | | | |
|---|---|---|---|---|
| 2003/0171934 | A1* | 9/2003 | Zhang et al. | 704/500 |
| 2003/0177011 | A1 | 9/2003 | Yasuda et al. | |
| 2003/0206558 | A1* | 11/2003 | Parkkinen et al. | 370/477 |
| 2003/0220783 | A1* | 11/2003 | Streich et al. | 704/200.1 |
| 2005/0154584 | A1 | 7/2005 | Jelinek et al. | |
| 2005/0163323 | A1 | 7/2005 | Oshikiri | |
| 2005/0240403 | A1* | 10/2005 | Zhou et al. | 704/229 |
| 2006/0036435 | A1 | 2/2006 | Kovesi et al. | |
| 2006/0265087 | A1 | 11/2006 | Philippe et al. | |
| 2007/0253481 | A1 | 11/2007 | Oshikiri | |
| 2007/0258607 | A1* | 11/2007 | Purnhagen et al. | 381/307 |
| 2007/0271092 | A1 | 11/2007 | Ehara et al. | |
| 2007/0271101 | A1 | 11/2007 | Sato et al. | |
| 2007/0299669 | A1 | 12/2007 | Ehara | |
| 2008/0052066 | A1 | 2/2008 | Oshikiri et al. | |
| 2008/0059166 | A1 | 3/2008 | Ehara | |
| 2008/0249766 | A1 | 10/2008 | Ehara | |
| 2009/0070107 | A1* | 3/2009 | Kawashima et al. | 704/229 |

FOREIGN PATENT DOCUMENTS

| | | | |
|---|---|---|---|
| JP | 10-233692 | | 9/1998 |
| JP | 2001-230675 | A | 8/2001 |
| JP | 2002-221994 | A | 8/2002 |
| JP | 2002-268696 | A | 9/2002 |
| JP | 2003-241799 | A | 8/2003 |
| JP | 2004-102186 | A | 4/2004 |
| JP | 2005-222014 | A | 8/2005 |
| JP | 2005-338200 | | 12/2005 |
| WO | 2002/071389 | A1 | 9/2002 |
| WO | 2004/081918 | A1 | 9/2004 |
| WO | 2005/036528 | A1 | 4/2005 |
| WO | 2005/066937 | A1 | 7/2005 |
| WO | 2005/106848 | | 11/2005 |
| WO | 2006/025313 | | 3/2006 |

OTHER PUBLICATIONS

Search report from E.P.O., mail date is Jun. 24, 2011.
English language Abstract of JP 2002-221994 A.
English language Abstract of JP 2002-268696 A.
Japan Office action that issued with respect to patent family member Japanese Patent Application No. 2008-510782, mail date is Mar. 21, 2012.
Examination Report from EPO dated Jun. 28, 2012.

* cited by examiner

| FRAME NUMBER n | CONDITION OF (n−1)-TH FRAME | CONDITION OF n-TH FRAME |
|---|---|---|
| n=1 | SILENCE | SILENCE |
| n=2 | SILENCE | ONSET |
| n=3 | ONSET | PITCH TRANSITION |
| n=4 | PITCH TRANSITION | STATIONARY VOICED |
| n=5 | STATIONARY VOICED | STATIONARY VOICED |

FIG.3A

| FRAME NUMBER n | REPAIRING ERROR (n−1) |
|---|---|
| n=1 | SMALL |
| n=2 | SMALL |
| n=3 | LARGE |
| n=4 | LARGE |
| n=5 | SMALL |

FIG.3B

| FRAME NUMBER n | CODING ERROR (n) |
|---|---|
| n=1 | SMALL |
| n=2 | LARGE |
| n=3 | LARGE |
| n=4 | SMALL |
| n=5 | SMALL |

FIG.3C

| FRAME NUMBER n | BIT ALLOCATION MODE |
|---|---|
| n=1 | 2 |
| n=2 | 2 |
| n=3 | 1 |
| n=4 | 1 |
| n=5 | 2 |

FIG.3D

SCALABLE ENCODING DEVICE AND SCALABLE ENCODING METHOD INCLUDING QUALITY IMPROVEMENT OF A DECODED SIGNAL

TECHNICAL FIELD

The present invention relates to a scalable coding apparatus and scalable coding method used in mobile communication systems. In particular, the present invention relates to improvement of robustness to packet loss of lower layers including the core layer.

BACKGROUND ART

In speech communications on an IP network, to realize network traffic control and multicast communication on the network, a scalable function, which enables a receiving apparatus to acquire decoded speech of certain quality even from part of encoded data, is anticipated.

In scalable coding (scalable speech coding) having this scalable function, by encoding an input speech signal into layers, encoded data with a plurality of layers including the lower layer to higher layers, are generated and transmitted. The receiving apparatus acquires decoded speech using encoded data with the lower layer to an arbitrary higher layer and thereupon acquires a decoded signal in varying quality, thereby decoding the speech in higher quality by decoding higher layers. Here, enhancement layer encoded data is directed to improving quality of the core layer.

By the way, when frame loss occurs in a channel, there is a technique of performing frame erasure concealment by extrapolating parameters received earlier in a speech decoding apparatus. However, for example, it is difficult to estimate a signal of speech onset using only the parameters received earlier. Consequently, it is not practical to realize robustness to packet loss using only the method of extrapolation-based concealment.

Therefore, besides extrapolation, there is a technique of adding in advance redundancy information for concealment processing upon transmission (see Patent Documents 1 and 2). By separately transmitting encoded data for concealment generated from this concealment information, it is possible to enhance error robustness.

Patent Document 1 discloses a technique of encoding the current frame by the first coding method, and, using its decoded signal, encoding a future signal by a second coding method (sub-codec), and outputting both encoded data at the same time. In this case, if the first encoded data is lost, high error robustness is realized by performing concealment using the second encoded data received earlier.

Patent Document 2 discloses a technique of encoding the current frame by the first coding method, extracting and encoding periodicity information such as the pitch of the future frame for packet loss concealment, and transmitting both data at the same time. As in Patent Document 1, if the encoded data of the current frame is lost, high error robustness is realized by performing concealment using the encoded data for concealment, which is received earlier.

Patent Documents 1 and 2 disclose using encoded data from a sub-codec which targets other periods than the current frame as encoded data for concealment, and transmitting this encoded data and the encoded data of the current frame by the first coding scheme at the same time. By this means, even when the encoded data of the current frame is lost, error robustness is emphasized by performing concealment using the supplementary information.

Patent Document 1: Japanese Patent Application Laid-Open No. 2002-221994

Patent Document 2: Japanese Patent Application Laid-Open No. 2002-268696

DISCLOSURE OF INVENTION

Problems to be Solved by the Invention

However, when concealment information is simply added on top of original enhancement layer encoded data by a scalable codec, there is a problem of increasing transmission rates of enhancement layers. A solution is suggested where the amount of codes of the original enhancement layer data is reduced, and, in proportion to this amount of reduced codes, a predetermined amount of codes of encoded data for concealment is assigned in a fixed manner. However, this causes another problem of causing speech deterioration even when there is no frame loss.

In view of the above, it is therefore an object of the present invention to provide a scalable coding apparatus or the like that enhances quality of a decoded signal and conceals data in sufficient quality upon data loss without increasing the amount of codes.

Means for Solving the Problem

The scalable coding apparatus of the present invention employs a configuration having: a core layer coding section that generates core layer encoded data using an input speech signal; and an enhancement layer coding section that, using the input signal, generates quality improving encoded data that improves quality of a decoded signal when decoded with the core layer encoded data, and encoded data for concealment to be used for data concealment when the core layer encoded data is lost.

Advantageous Effect of the Invention

According to the present invention, it is possible to enhance quality of a decoded signal and conceal data in sufficient quality upon data loss without increasing the amount of codes.

BRIEF DESCRIPTION OF DRAWINGS

FIG. 3 illustrates the bit allocation method according to Embodiment 1 in detail;

BEST MODE FOR CARRYING OUT THE INVENTION

An embodiment of the present invention will be explained below in detail with reference to the accompanying drawings.

(Embodiment 1)

Figure 1:
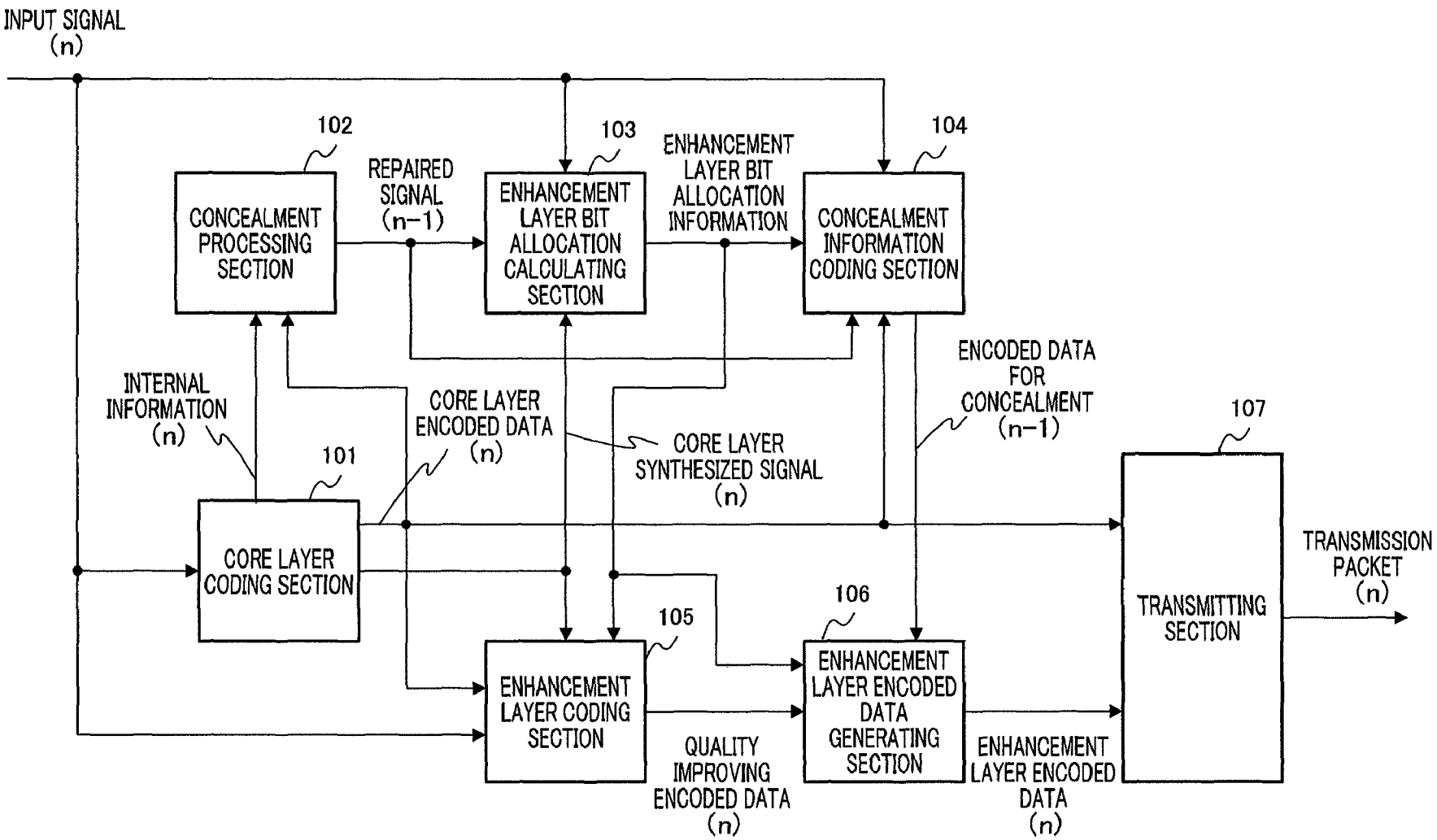
FIG. 1 is a block diagram showing main components of a scalable coding apparatus according to Embodiment 1 of the present invention.

FIG. 1 is a block diagram showing main components of the scalable coding apparatus according to Embodiment 1 of the present invention.

The scalable coding apparatus according to the present embodiment is provided with core layer coding section 101, concealment processing section 102, enhancement layer bit allocation calculating section 103, concealment information coding section 104, enhancement layer coding section 105, enhancement layer encoded data generating section 106 and transmitting section 107.

When a speech signal is inputted to the scalable coding apparatus of the present embodiment, sections of this scalable coding apparatus perform the following operations, thereby generating core layer encoded data and enhancement layer encoded data and outputting transmission packets packetizing both data in one packet, to the counterpart decoding apparatus. Here, a case will be explained where a speech signal of the n-th frame is inputted as an example.

Core layer coding section 101 encodes an input signal and generates three types of signals, namely the core layer synthesized signal of the n-th frame, the core layer encoded data of the n-th frame and the internal information of the n-th frame. To be more specific, coding processing is performed on an input signal such that the coding distortion of the core layer synthesized signal is minimized, and then this core layer synthesized signal subjected to coding processing and encoded data required for acquiring this core layer synthesized signal (core layer encoded data) are outputted. Further, internal information (e.g., prediction residual and the synthesized filter coefficients, etc.) of core layer coding section 101 required in coding processing is outputted. The core layer encoded data is outputted to transmitting section 107, the core layer synthesized signal is outputted to enhancement layer bit allocation calculating section 103 and enhancement layer coding section 105, and the internal information is outputted to concealment processing section 102.

The functions of enhancement layer coding section 105 include performing high-quality coding compared to core layer coding section 101 by encoding a difference between the core layer synthesized signal generated in core layer coding section 101 and the input signal, that is, by encoding a signal that cannot be encoded sufficiently in the core layer. To be more specific, enhancement layer coding section 105 encodes the input signal using the core layer synthesized signal of the n-th frame and the core layer encoded data of the n-th frame, and acquires quality improving encoded data (of the n-th frame) that improves the quality of a decoded signal when decoded with supplementary encoded data for the core layer encoded data, that is, when decoded with the core layer encoded data in the decoding apparatus. This quality improving encoded data is outputted to enhancement layer encoded data generating section 106. The number of bits of encoded data to be generated in enhancement layer coding section 105 is designated by enhancement layer bit allocation information to be outputted from enhancement layer bit allocation calculating section 103. Here, the enhancement layer bit allocation information will be described later. Enhancement layer coding section 105 switches coding processing depending on the designated number of bits.

Enhancement layer bit allocation calculating section 103 generates enhancement layer bit allocation information based on the input signal of the n-th frame, the repaired signal of the (n−1)-th frame and the core layer synthesized signal of the n-th frame, and outputs this information to concealment information coding section 104. Bit allocation processing in enhancement layer bit allocation calculating section 103 will be described later in detail.

Concealment processing section 102 stores the inputted internal information and core layer encoded data in an internal memory in advance, performs concealment processing on the (n−1)-th frame using the internal information of the (n−2)-th frame and the core layer coding information of the (n−2)-th frame, and outputs the acquired repaired signal of the (n−1)-th frame to enhancement layer bit allocation calculating section 103 and concealment information coding section 104.

Concealment information coding section 104 stores the inputted core layer encoded data of the n-th frame in an internal memory in advance, extracts part of the core layer encoded data of the (n−1)-th frame, which is the previous frame of the n-th frame, and outputs this extracted data to enhancement layer encoded data generating section 106 as encoded data for concealment for the core layer of the (n−1)-th frame. Here, extracting part of the core layer encoded data refers to, for example, extracting only the pitch information or extracting the pitch information and gain information from the core layer encoded data. The number of bits of the encoded data for concealment, which is generated in concealment information coding section 104 is designated by the enhancement layer bit allocation information outputted from enhancement layer bit allocation calculating section 103. Further, coding processing is also performed on the n-th frame, so that the concealment information for the (n−1)-th frame is efficiently encoded using the core layer decoded information of the n-th frame. For example, it is possible to perform difference quantization or perform a prediction by interpolation using the decoded information of the (n−2)-th frame. Further, it is also possible to encode the difference between the repaired signal of the (n−1)-th frame and the core layer synthesized signal (or input signal) of the (n−1)-th frame, and output the result as encoded data for concealment.

Enhancement layer encoded data generating section 106 multiplexes the enhancement layer bit allocation information outputted from enhancement layer bit allocation calculating section 103, the encoded data for concealment of the (n−1)-th frame outputted from concealment information coding section 104 and the quality improving encoded data of the n-th frame outputted from enhancement layer coding section 105, and outputs the result to transmitting section 107 as enhancement layer encoded data of the n-th frame.

Transmitting section 107 acquires the core layer encoded data of the n-th frame from core layer coding section 101 and the enhancement layer encoded data of the n-th frame from enhancement layer encoded data generating section 106, stores these data as true encoded data in respective transmission packets of the n-th frame and outputs these to channels.

Here, packets storing the core layer encoded data may be subjected to priority control which assigns a high priority level to these packets compared to packets storing the enhancement layer encoded data in the communication system. In this case, the packets storing the core layer encoded data are unlikely to be lost in transmission channels.

Figure 2:
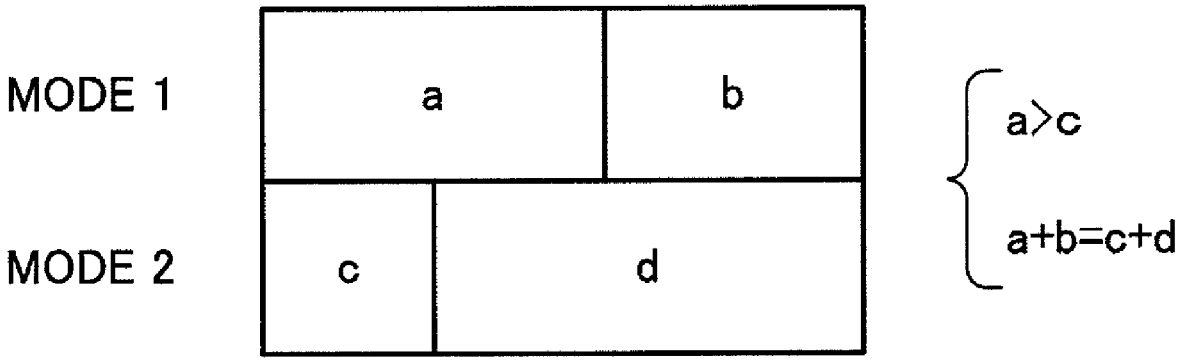
FIG. 2 illustrates bit allocation modes according to Embodiment 1.

Next, the bit allocation method in enhancement layers according to the present embodiment will be explained. Here, this bit allocation method is performed in enhancement layer bit allocation calculating section 103, To be more specific, the bit allocation method according to the present embodiment sets in advance bit allocation modes for multiple patterns of uneven bit allocations to enhancement layer encoded data as shown in FIG. 2, selects one bit allocation mode out of these bit allocation modes and performs bit allocation according to the selected mode. In this figure, "a" to "d" show the amount of bits to be assigned to each data, which refers to, for example, encoded data for concealment and quality improving encoded data. In this example, there are only two kinds of bit allocation modes, namely, mode 1 and mode 2.

Enhancement layer bit allocation calculating section 103 finds three indexes of the input speech signal, core layer synthesized signal and repaired signal, where 1: the state of the input speech signal;

2: the level of quality improvement of a decoded signal by quality improving encoded data; and 3: the level of data concealment performance by encoded data for concealment, and selects a bit allocation mode according to these indexes.

Actually, index 2 and index 3 change depending on the result of index 1. Enhancement layer bit allocation calculating section 103 adaptively determines bit allocation, based on indexes 1 to 3, by comprehensively judging which is more effective to assign more bits to the quality improving encoded data or the encoded data for concealment.

To be more specific, enhancement layer bit allocation section 103 decides the speech mode of each frame of the input speech signal and decides the state of the input speech signal based on a change of the decided speech mode, that is based on how this speech mode changes between adjacent frames by finding a speech mode representing what characteristic the speech signal has, including: whether or not the input speech signal is a speech period signal; whether the speech signal is a voiced period signal or the speech signal is an unvoiced period signal if the speech signal is a speech period signal; and whether or not the speech signal is a stationary voiced period signal if the speech signal is a voiced period signal. Further, according to the present embodiment, a plurality of speech modes are defined in advance and which of these modes the input speech signal matches is decided. To be more specific, by analyzing, for example, fluctuation of the linear prediction coefficient, pitch and power of the input speech signal, a speech mode is decided.

Further, enhancement layer bit allocation calculating section 103 calculates the difference (distortion) of the core layer synthesized signal acquired by core layer coding processing, that is, enhancement layer bit allocation calculating section 103 calculates and uses the difference between the core layer synthesized signal and the input signal, as the level of quality improvement of the decoded signal by the quality improving encoded data. Further, the repairing error which is contained in the data repaired using encoded data for concealment (a repaired signal acquired by concealment processing), that is, the difference between the core layer synthesized signal and the repaired signal, is calculated and used as the level of data repairing performance brought by encoded data for concealment.

FIG. 3 illustrates the bit allocation method according to the present embodiment in detail. Here, by illustrating a state of an input speech signal in detail as an example, the figure shows how the bit allocation according to the present embodiment is performed. This figure shows a state where time advances in the direction from the top to the bottom and shows a series of speech periods from an unvoiced period to a stationary voiced period through a speech onset period.

FIG. 3A shows speech modes in the (n−1)-th frame to be concealed and speech modes in the (n−1)-th frame of which enhancement layer is encoded. FIG. 3B shows repairing error. FIG. 3C shows the difference between a core layer local decoded signal and an input signal, that is, FIG. 3C shows coding error. FIG. 3D shows enhancement layer bit allocation information (bit allocation mode) determined based on conditions of FIGS. 3A to 3C.

However, to explain the change of speech mode between adjacent frames in the following explanation, the state of the (n−1)-th frame and the state of the n-frame state is illustrated in pair. For example, FIG. 3A illustrates (silence, silence) when the (n−1)-th frame is a silent mode and the n-th frame is also an unvoiced mode.

Cases will be explained in order from n=1. In the case of n=1, the speech mode is (silence, silence), which shows that both repairing error and coding error are small. When these two types of errors are both small, both bit allocation can be reduced and arbitrary bit allocation can be performed for total bits assigned in advance. In this example, although the speech mode is silence, it is possible to perform arbitrary bit allocation. In this case, assuming priority can be given to quality improving information over concealment information, mode 2 that reduces bits to be assigned to the concealment information, is selected. Further, when the two types of errors are both large and the speech mode is (noise, noise), that is, when the speech signals are background noise period signals, the above case is applicable, that is, mode 2 is selected. The speech mode information plays an important role in determination of the bit allocation mode in the case of speech modes of (noise, noise). However, in the case where the speech mode is (silence, silence), speech mode information is not always related to determination of a bit allocation mode.

In the case of n=2, the speech mode is (silence, onset), which shows small repairing error and large core layer coding error. The repairing error is small, and the core layer coding error is large. Consequently, more bits need to be assigned to the quality improving information than the concealment information. Therefore, mode 2 is selected as the bit allocation mode. Thus, the frame on which concealment information is encoded, and the frame on which quality improving information is encoded, are placed in different positions in time. This causes a shift between the contours of the number of bits required to encode the concealment information and the number of bits required to encode the quality improving information, thereby it is possible to reduce the increase of overall bit rates of both information. The present invention focuses on this point.

In the case of n=3, speech modes is (onset, pitch transition), thereby increasing both the repairing error and the core layer coding error. Consequently, assume that, in a case where the number of overall bits is sufficient, even bit allocation is applied to the concealment information and the quality improving information so as to allocate sufficient bits to the concealment information and the quality improving information. However, in a case where the total number of bits is not sufficient, overall quality can be improved by giving preference to one of concealment information and quality improving information. Generally, the onset period is difficult to conceal by extrapolation and has a significant influence on the speech quality of subsequent periods. That is, unless the onset period is decoded in high quality, encoded information of the subsequent periods are not useful. This phenomenon is commonly seen in high efficiency coding using past encoded data like CELP coding. Therefore, in the case of n=3, more bits need to be assigned to the encoded data for concealment. Although the quality improving encoded data requires many bits when the speech mode is pitch transition, it is concluded that more disadvantages can be caused upon losing data of the onset period compared to the above case, and, consequently, more bits are assigned to the encoded data for concealment. Therefore, mode 1 is selected as the bit allocation mode.

Further, the advantage of finally determining bit allocation depending on whether or not the speech mode is onset, is also acquired in the following case. That is, even if the speech mode of a frame is decided to be onset, cases are assumed where the onset period starts from the beginning of the frame and where the onset period starts from the end of the frame. In this case, there may be large repairing error between the former and the latter. In the latter, even when the repairing error is small, and, as a result, the number of bits to be assigned to concealment information is decided to be small, the number of bits to be assigned to concealment information can be decided again to be large taking into consideration that the frame is an onset frame.

In the case of n=4, the speech mode is (pitch transition, stationary voiced), and the repairing error is large and the core layer error is small. Consequently, more bits may be assigned to the concealment information and less bits may be assigned to the quality improving information. Therefore, mode 1 is selected. Here, it is possible to determine a bit allocation mode not depending on the speech modes.

In the case of n=5, speech modes is (stationary voice, stationary voice), and the repairing error and the core layer coding error are both small. In this case, as in n=1, arbitrary bit allocation is possible. Here, in a case of the state of stationary voiced, it is relatively easy to conceal a lost frame even by the concealment method of extrapolation, so that it is decided to assign fewer bits to the concealment bits, thereby selecting mode 2 that assigns more bits for quality improvement.

As described above, the scalable coding apparatus according to the present embodiment can satisfy both concealment performance and quality improvement performance by adaptively controlling the allocation of bits to be assigned to encoded data for concealment and quality improving encoded data based on, for example, speech mode.

FIG. 4 illustrates a data configuration of enhancement layer encoded data to which bits have actually been distributed.

Figure 4A:
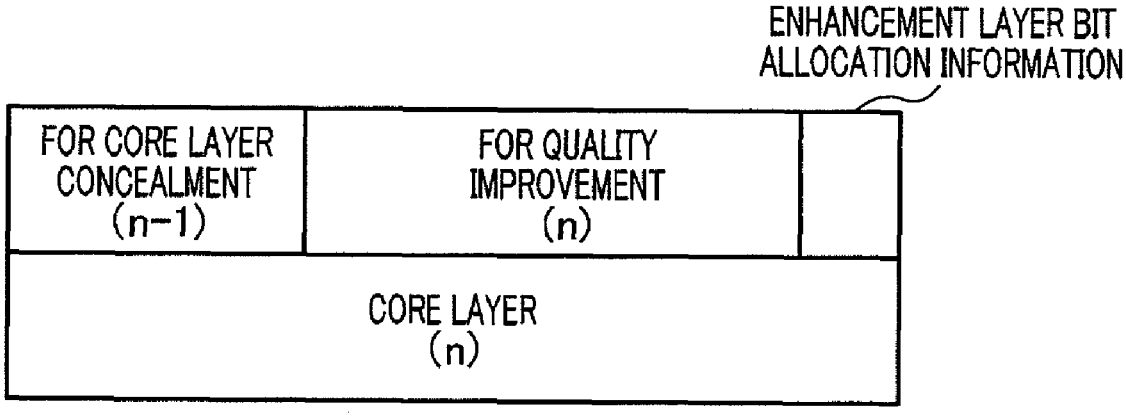
FIG. 4 illustrates a data configuration of an enhancement layer.
Figure 4B:
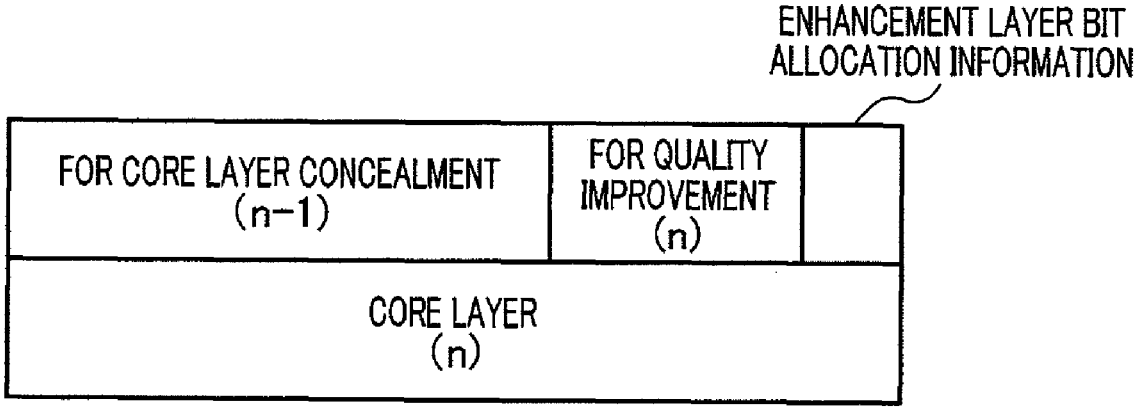

FIGS. 4A and 4B show data configurations of encoded data, and, for ease of understanding, also show core layer encoded data. In these figures, the lower data and the upper data represent core layer encoded data and enhancement layer encoded data, respectively. Here, assume that the core layer and enhancement layers provide the same amount of bits.

In FIG. 4A, core layer encoded data for concealment of the (n−1)-th frame is stored in the enhancement layers. Here, the amount of bits to be assigned to the core layer encoded data for concealment and quality improving encoded data is controlled according to, for example, the change of the speech mode of an input signal. This is equivalent to mode 2 of FIG. 3.

On the other hand, in FIG. 4B, although core layer encoded data for concealment is also stored in the enhancement layers, the relationship is opposite between the amount of bits to be assigned to the core layer encoded data for concealment and the amount of bits to be assigned to quality improving encoded data, compared to the relationship of FIG. 4A. This is equivalent to mode 1 of FIG. 2.

As shown in FIGS. 4A and 4B, enhancement layer encoded data of the n-th frame stores quality improving encoded data of the n-th frame, encoded data for concealment of the (n−1)-th frame and enhancement layer bit allocation information.

Figure 5:
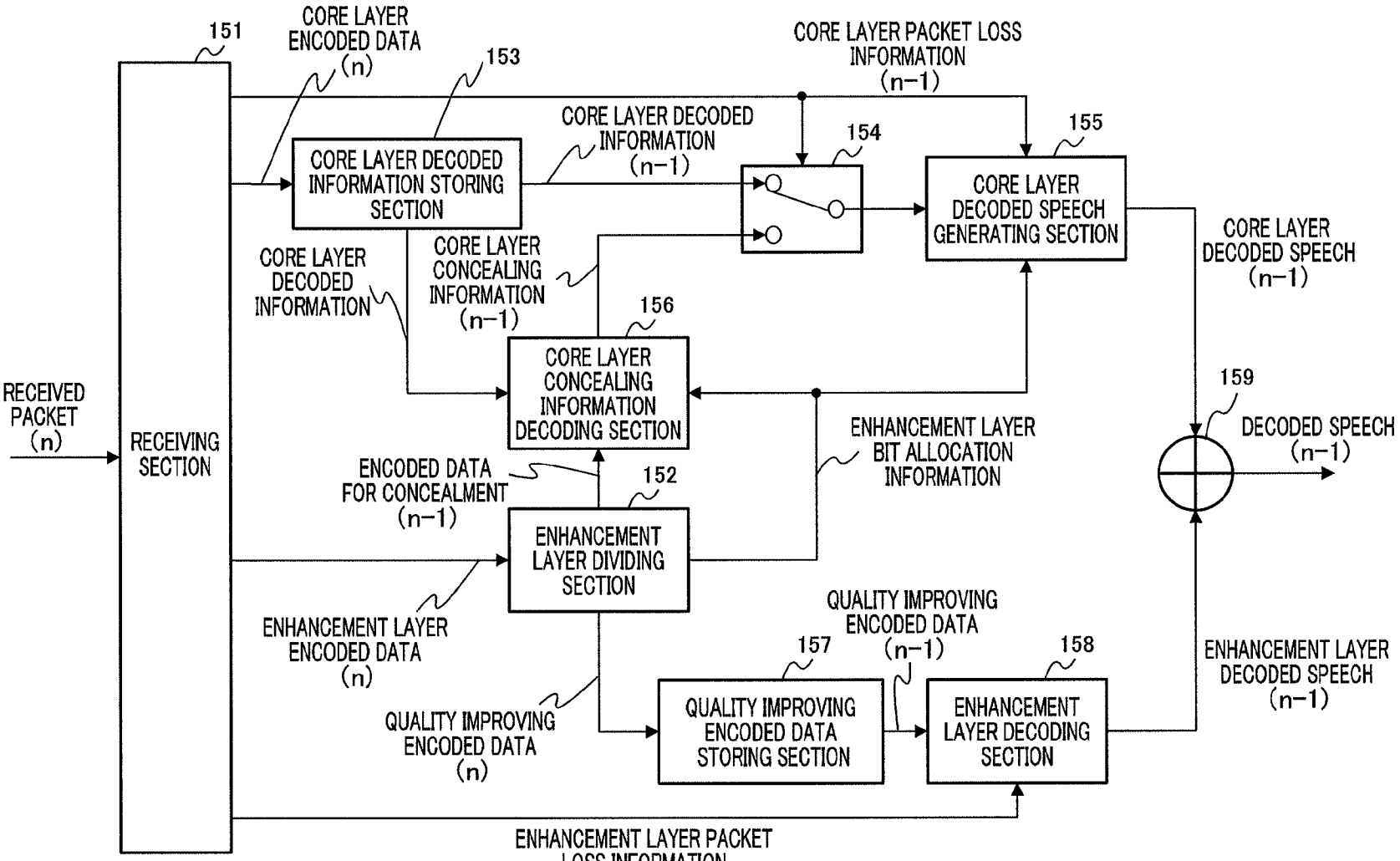
FIG. 5 is a block diagram showing main components of a scalable decoding apparatus according to Embodiment 1.

FIG. 5 is a block diagram showing main components of the scalable decoding apparatus according to the present embodiment supporting the scalable coding apparatus according to the above present embodiment.

The scalable decoding apparatus according to the present embodiment is provided with receiving section 151, enhancement layer data dividing section 152, core layer decoded information storing section 153, switch 154, core layer decoded speech generating section 155, core layer concealing information decoding section 156, quality improving encoded data storing section 157, enhancement layer decoding section 158 and adding section 159, receives packets transmitted from the scalable coding apparatus according to the present embodiment, performs decoding processing and outputs the acquired decoded speech.

Receiving section 151 receives packets and outputs core layer encoded data, enhancement layer encoded data, core layer packet loss information and enhancement layer packet loss information. The core layer encoded data is outputted to core layer decoded information storing section 153 and the enhancement layer encoded data is outputted to enhancement layer data dividing section 152. Further, the core layer packet loss information and the enhancement layer packet loss information indicate packet loss (e.g., which refers to a state packets cannot be received and packets include error) in encoded data of these layers. Therefore, when core layer encoded data is lost, core layer packet loss information is outputted to core layer decoded speech generating section 155 and switch 154, and, when enhancement layer encoded data is lost, enhancement layer packet loss information is outputted to enhancement layer decoding section 158.

Enhancement layer data dividing section 152 receives the enhancement layer encoded data, and divides and outputs the enhancement layer bit allocation information, the encoded data for concealment and the quality improving encoded data from this enhancement layer encoded data. The enhancement layer allocation information is outputted to core layer concealing information decoding section 156 and core layer decoded speech generating section 155. The encoded data for concealment is outputted to core layer concealing information decoding section 156. The quality improving encoded data is outputted to quality improving encoded data storing section 157.

Core layer decoded information storing section 153 receives the core layer encoded data from receiving section 151, decodes this data and outputs the acquired core layer decoded information to switch 154 and stores this information in an internal memory. This core layer decoded information is decoded data of the frame to be decoded by the encoded data for concealment. Further, core layer decoded information storing section 153 outputs future/past core layer decoded information instead of the core layer decoded information outputted to switch 154, to core layer concealing information decoding section 156.

Core layer concealing information decoding section 156 receives the encoded data for concealment and the enhancement layer bit allocation information, decodes the encoded data for concealment and outputs the core layer concealing information to switch 154. Here, as for parameters not included in the concealment information from the scalable coding apparatus according to the present embodiment, it is also possible to acquire these parameters by interpolation or the like using past/future core layer decoded information (information decoded from encoded data that is received and not yet decoded) from core layer decoded information storing section 153.

Switch 154 receives as input the core layer decoded information and the core layer concealing information, selects and outputs one of these information based on the core layer packet loss information. To be more specific, when the core layer decoded information is decided not lost based on the core layer packet loss information, switch 154 selects and outputs the core layer decoded information. By contrast, when the core layer decoded information is decided lost based on the core layer packet loss information, switch 154 selects and outputs the core layer concealing information.

Core layer decoded speech generating section 155 receives as input the core layer decoded information or the core layer compensating information, generates decoded speech using the inputted information and outputs the acquired core layer decoded speech.

Quality improving encoded data storing section 157 stores the inputted quality improving encoded data, and, in the case of the frame subjected to the encoded data for concealment, outputs the quality improving encoded data for this frame to enhancement layer decoding section 158.

Enhancement layer decoding section 158 acquires the quality improving encoded data extracted in enhancement layer data dividing section 152 from quality improving encoded data storing section 157 and decodes enhancement layer decoded speech. When enhancement layer encoded data of the frame to be decoded is recognized lost based on the enhancement layer packet loss information, enhancement layer decoding section 158 outputs nothing or performs concealment processing. This concealment processing is performed by, for example, estimating parameters from past parameters and performing decoding.

Adding section 159 adds the core layer decoded speech outputted from core layer decoded speech generating section 155 and the enhancement layer decoded speech outputted from enhancement layer decoding section 158, and outputs the added signal as decoded speech of the scalable decoding apparatus.

Here, when the core layer encoded data and the encoded data for concealment are decided lost based on the core layer packet loss information, decoding processing is performed after repairing all parameters. When only the core layer encoded data is lost and the core layer encoded data for concealment can be received, decoding processing is performed using parameters acquired from the core layer encoded data for concealment. However, if there are parameters that cannot be acquired from the core layer encoded data for concealment, decoding processing is performed after these parameters are repaired.

Thus, the scalable decoding apparatus according to the present embodiment employs the above configuration and thereby can decode layered encoded data generated in the scalable coding apparatus according to the present embodiment.

As described above, according to the present embodiment, enhancement layer encoded data is comprised of quality improving encoded data and encoded data for loss concealment. That is, enhancement layer encoded data includes quality improving encoded data to maintain certain quality. Therefore, even when core layer encoded data is lost, it is possible to acquire decoded speech with sufficient quality. Further, if core layer encoded data is not lost, it is possible to acquire decoded speech with higher quality by receiving enhancement layer encoded data.

Further, according to the present embodiment, the amount of bits to be assigned to quality improving encoded data and core layer encoded data for concealment is determined on a per frame basis, using the change of conditions of repairing error, core layer coding error and input speech signal. By this means, it is possible to enhance quality of a decoded signal and improve robustness performance to packet loss with the increase of bit rates controlled.

Further, focusing on the time lag between the change of the amount of quality improving encoded data needed for quality improvement and the change of the amount of encoded data for loss concealment needed for loss concealment, the amount of codes (bit rates) to be assigned to both encoded data is adaptively controlled. By this means, it is possible to reduce the total amount of encoded data of a frame.

Further, according to the present embodiment, a frame to be encoded by core layer codes for concealment is assumed a past frame compared to a frame subjected to core layer coding. Therefore, a scalable decoding apparatus uses encoded data of the n-th frame to perform concealment processing on the (n−1)-th frame, thereby enabling concealment performance to be improved.

Further, according to the present embodiment, in concealment processing in the scalable decoding apparatus, by delaying the processing by one frame and performing concealment processing using encoded data of the frames before and after the loss frame, it is possible to improve concealment performance. Here, if the algorithm delay due to the decoding processing for the original enhancement layers is greater than the algorithm delay of the core layer, one frame delay required in the scalable decoding apparatus according to the present embodiment stays within the range of the algorithm delay of the enhancement layers. That is, this delay is the same as in general decoding processing, and, on the whole, there are no processing delays.

Figure 6:
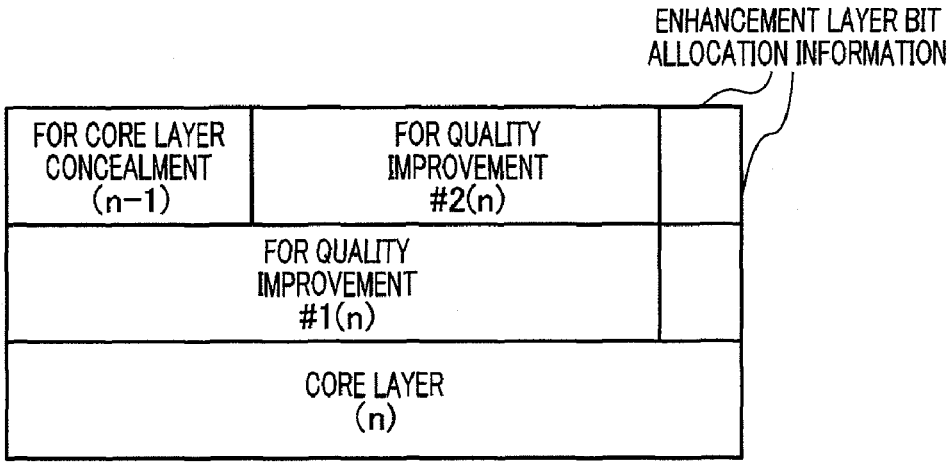
FIG. 6 shows a variation of arrangement of encoded data for concealment in enhancement layers.
Figure 7:
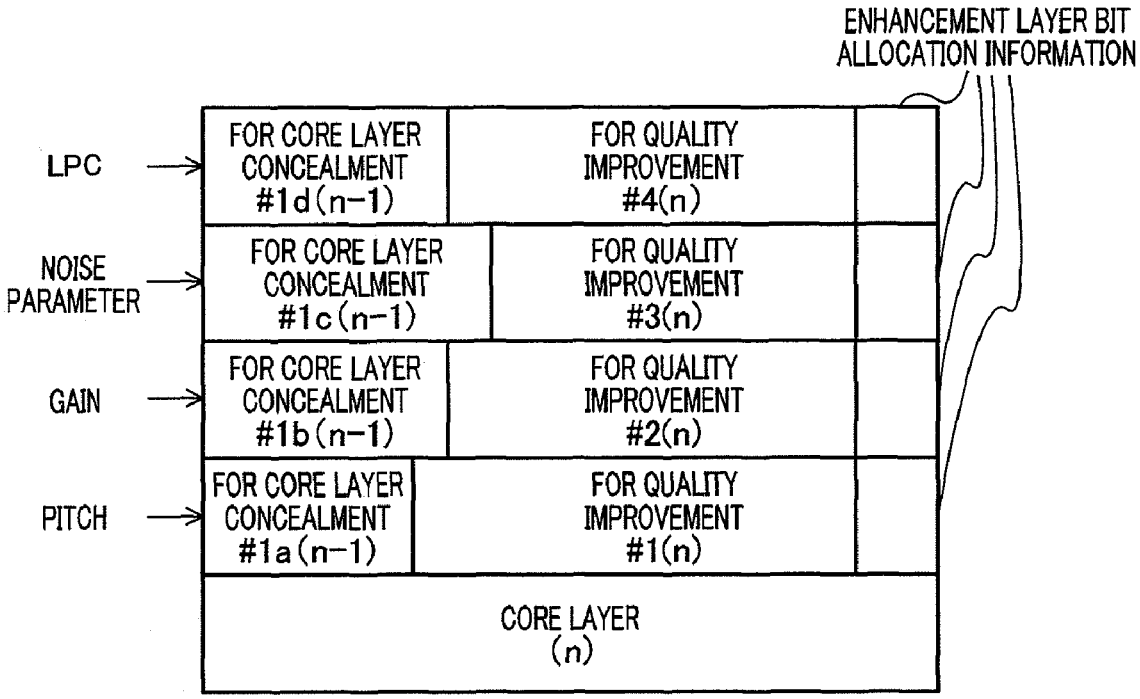
FIG. 7 shows a variation of arrangement of encoded data for concealment in enhancement layers.

Further, although FIG. 4 shows an example of a data configuration of enhancement layer encoded data, it is also possible to arrange encoded data for concealment for the enhancement layers in a different way. FIGS. 6 and 7 illustrate arrangement variations of encoded data for concealment for enhancement layers.

In these figures, the data in the bottom stage refers to core layer encoded data and the other upper data refer to the encoded data of each of enhancement layers. Here, the amount of bits in the core layer is the same as in the enhancement layers.

FIG. 6 shows an example of, when degree of contribution by quality improving encoded data #2 is less than by quality improving encoded data #1, reducing the amount of information of quality improving encoded data #2 and assigning more bits to core layer encoded data for concealment in proportion to the amount of reduced information. In this example, enhancement layer bit allocation information is not always required for all enhancement layers.

Thus, by assigning core layer encoded data for concealment to the enhancement layers instead of the core layer, in particular, by assigning core layer encoded data for concealment to encoded data of the higher enhancement layer, even when encoded data for concealment is added to an input speech signal (period) where the quality improvement effect in the enhancement layers is saturated, quality does not deteriorate at all.

FIG. 7 shows an image of dividing and storing core layer encoded data per parameter as encoded data for concealment, that is, FIG. 7 shows assigning parameters of higher priority to the lower layer and parameters of lower priority to higher layers. Further, when there are a plurality of pitches and gain information, it is possible to assign them to different layers. In this case, there may be parameters that do not belong to any layers.

Thus, core layer encoded data for concealment is divided into a plurality of enhancement layers and assigned, and encoded data of concealing information of higher priority is assigned to the lower enhancement layer. By this means, core layer encoded data for concealment is divided into a plurality of layers, so that the number of bits of encoded data for concealment per layer is reduced, thereby suppressing quality degradation due to the assignment of data other than quality improving encoded data.

Further, although a configuration example has been described with the present embodiment where all of the three parameters, namely, the speech mode of an input signal, the repairing error of the core layer and the coding error of core layer encoded data, are used as a reference to determine bit allocation, it is also possible to use only one of these parameters. For example, it is possible to determine a bit allocation mode to be used, based on only a determination result of the speech mode.

Further, it is possible to monitor error in a channel and determine bit allocation based on the error condition. In this case, a configuration is employed such that assignments in the enhancement layers of concealing information are controlled. That is, when there are more errors in channels, control is performed such that allocation of bits to be assigned to concealing information is increased and concealing information of higher priority is assigned to the lower layer. By this means, error robustness is improved, thereby improving overall speech quality.

Further, although a configuration example has been described with the present embodiment where the difference between a core layer synthesized signal and a repaired signal is used as repairing error, it is also possible to employ a configuration using the difference between the input speech signal and a repaired signal.

Further, although a configuration example has been described with the present embodiment where three parameters, the speech mode of an input signal, the repairing error of the core layer and the coding error of core layer encoded data are used to determine bit allocation, it is also possible to employ a configuration using other parameters than these three parameters.

Further, although a configuration example has been described with the present embodiment where coding processing is switched according to the number of bits designated in enhancement layer coding section 105, it is also possible to employ a configuration outputting part of encoded data that is encoded using the fixed number of bits.

Further, although a configuration example has been described with the present embodiment where concealing information coding section 104 selects part of core layer encoded data and generates encoded data for concealment, it is also possible to employ a configuration generating encoded data for concealment by encoding the error signal between the input speech signal of the (n−1)-th frame (or the core layer synthesized signal of the (n−1)-th frame) and a repaired signal for the (n−1)-th frame.

Further, although a configuration example has been described with the present embodiment where both core layer encoded data and enhancement layer encoded data are transmitted in different packets, both encoded data can be transmitted in different packets as in the present embodiment and both encoded data can be transmitted in the same packets, depending on the adapted communication system.

An embodiment of the present invention has been explained above.

The scalable coding apparatus or the like according to the present invention are not limited to above-described embodiments and can be implemented with various changes.

Further, the scalable coding apparatus according to the present invention can be mounted on a communication terminal apparatus and base station apparatus in the mobile communication system, so that it is possible to provide a communication terminal apparatus, base station apparatus and mobile communication system having the same operational effect as above.

Although a case has been described with the above embodiments as an example where the present invention is implemented with hardware, the present invention can be implemented with software. For example, by describing the scalable coding method according to the present invention in a programming language, storing this program in a memory and making the information processing section execute this program, it is possible to implement the same function as the scalable coding apparatus of the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2006-075535, filed on Mar. 17, 2006, including the specification, drawings and abstract, is incorporated herein by reference in its entirety.

Industrial Applicability

The scalable coding apparatus and scalable coding method according to the present invention can be applicable to applications such as a communication terminal apparatus and base station apparatus in the mobile communication system.

The invention claimed is:

1. A scalable coding apparatus comprising:

a core layer coder that generates, using at least one processor, core layer encoded data using an input speech signal;

an enhancement layer coder that, using the input signal, generates quality improving encoded data that improves quality of a decoded signal when decoded with the core layer encoded data, and encoded data for concealment, configured to repair data when the core layer encoded data is lost;

a decider that decides a speech mode of the input speech signal; and a bit distributor that performs bit allocation for the quality improving encoded data and the encoded data for concealment, wherein the speech mode represents a voiced period, an unvoiced period, a stationary voiced period or a non-stationary voiced period.

2. The scalable coding apparatus according to claim 1, further comprising:

a transmitter that multiplexes and transmits the core layer encoded data, the quality improving encoded data, the encoded data for concealment and bit allocation information which represents bit allocation for the quality improving encoded data and the encoded data for concealment.

3. The scalable coding apparatus according to claim 1, further comprising:

a calculator that calculates a coding error of a decoded signal decoded with the quality improving encoded data; and a bit distributor that distributes bits for the quality improving encoded data and the encoded data for concealment based on a degree of the calculated coding error.

4. The scalable coding apparatus according to claim 1, further comprising:

a calculator that calculates a repairing error of data repaired by the encoded data for concealment; and a bit distributor that distributes bits for the quality improving encoded data and the encoded data for concealment based on a degree of the calculated repairing error.

5. The scalable coding apparatus according to claim 1, wherein the enhancement layer coder sets a target frame for the encoded data for concealment with an earlier frame than a target frame of the core layer encoded data.

6. The scalable coding apparatus according to claim 1, wherein the enhancement layer coder sets the encoded data for concealment with higher enhancement layer encoded data.

7. The scalable coding apparatus according to claim 1, wherein the enhancement layer coder sets the encoded data for concealment with enhancement layer encoded data in a plurality of layers.

8. The scalable coding apparatus according to claim 7, wherein the enhancement layer coder sets more important encoded data for concealment with low enhancement layer encoded data.

9. A communication terminal apparatus comprising the scalable coding apparatus according to claim 1.

10. A base station apparatus comprising the scalable coding apparatus according to claim 1.

11. A computer-implemented scalable coding method comprising:

generating core layer encoded data, utilizing at least one processor, using an input signal;

using the input signal and generating quality improving encoded data that improves quality of a decoded signal when decoded with the core layer encoded data, and encoded data for concealment, configured to repair data when the core layer encoded data is lost;

deciding a speech mode of the input speech signal; and performing bit allocation for the quality improving encoded data and the encoded data for concealment, wherein the speech mode represents a voiced period, an unvoiced period, a stationary voiced period or a non-stationary voiced period.

12. The scalable coding method according to claim 11, further comprising:

multiplexing and transmitting the core layer encoded data, the quality improving encoded data, the encoded data for concealment and bit allocation information which represents bit allocation for the quality improving encoded data and the encoded data for concealment.

13. The scalable coding method according to claim 11, further comprising:

calculating an coding error of a decoded signal decoded with the quality improving encoded data; and distributing bits for the quality improving encoded data and the encoded data for concealment based on a degree of the calculated coding error.

14. The scalable coding method according to claim 11, further comprising:

calculating a repairing error of data repaired by the encoded data for concealment; and distributing bits for the quality improving encoded data and the encoded data for concealment based on a degree of the calculated repairing error.

15. The scalable coding method according to claim 11, wherein the using comprises setting a target frame for the encoded data for concealment with an earlier frame than a target frame of the core layer encoded data.

16. The scalable coding method according to claim 11, wherein the using comprises setting the encoded data for concealment with higher enhancement layer encoded data.

17. The scalable coding method according to claim 11, wherein the using comprises setting the encoded data for concealment with enhancement layer encoded data in a plurality of layers.

18. The scalable coding method according to claim 17, wherein the using comprises setting more important encoded data for concealment with low enhancement layer encoded data.

* * * * *